US005980580A

United States Patent [19]

Yamaguchi et al.

[11] Patent Number: 5,980,580

[45] **Date of Patent: *Nov. 9, 1999**

[54] WASHING METHOD AND DETERGENT COMPOSITIONS

[75] Inventors: Shu Yamaguchi; Katsuhiko Kasai; Yoko Yamaguchi; Shigeru Tamura; Masaki Tsumadori; Hiroyuki Yamashita, all of Wakayama, Japan

[73] Assignee: KAO Corporation, Tokyo, Japan

[ * ] Notice: This patent is subject to a terminal disclaimer.

[21] Appl. No.: 08/817,999

[22] PCT Filed: Sep. 2, 1996

[86] PCT No.: PCT/JP96/02485

§ 371 Date: May 1, 1997

§ 102(e) Date: May 1, 1997

[87] PCT Pub. No.: WO97/09414

PCT Pub. Date: Mar. 13, 1997

[30] Foreign Application Priority Data

Sep. 4, 1995 [JP] Japan ..... 7-251998

[51] Int. Cl.[6] ..... C11D 17/00; C11D 3/08; C11D 3/10; D06L 1/16

[52] U.S. Cl. ..... 8/137; 510/531; 510/532; 510/535; 510/441; 510/445; 510/438; 510/349; 510/276; 510/353; 510/356; 510/360; 510/357

[58] Field of Search ..... 8/137; 510/531, 510/532, 535, 441, 445, 438, 349, 276, 353, 356, 360, 357

[56] References Cited

U.S. PATENT DOCUMENTS 4,255,148 3/1981 Reinwald et al. ..... 8/137
4,666,740 5/1987 Wixon ..... 510/356
4,869,843 9/1989 Saito et al. .
5,108,646 4/1992 Beerse et al. .

OTHER PUBLICATIONS

Database WPI, Derwent Info. Ltd., Jp–58213099–A (1983) (abstract), Acc No. 84–021224/198404 (Month unknown).
Database WPI, Derwent Info. Ltd., JP–91052798–B (1991) (abstract), Acc No. 84–259616/198442 (Month unknown).
Database WPI, Derwent Info. Ltd., JP–6502445 (1994) (abstract), Acc No. 92–166443/199220 (Month unknown).
Database WPI, Derwent Info. Ltd., JP–55052396–A (1980) (abstract) Acc No. 80–33051C/198019 (Month unknown.
Database WPI, Derwent Info. Ltd., JP–62167399–A (1987) (abstract), Acc No. 87–200130/198729 (Month unknown).

*Primary Examiner*—Alan Diamond
*Attorney, Agent, or Firm*—Birch, Stewart, Kolasch & Birch, LLP

[57] ABSTRACT

A washing method characterized in that washing is carried out under conditions that a pH of a washing liquid starts increasing after a water hardness of the washing liquid starts decreasing; a detergent composition characterized by containing particles capable of delayed-exerting an alkalizing effect of a washing liquid, wherein a pH of a washing liquid starts increasing after a water hardness of the washing liquid starts decreasing; and a detergent composition comprising an alkalizing agent coated with an organic material, or organic and inorganic materials, the alkalizing agent occupying an amount of 70% by weight or more of the entire alkalizing agents in the detergent composition. In the washing method and the detergent composition of the present invention, since washing is carried out under conditions that a pH of a washing liquid starts increasing after a water hardness of the washing liquid starts decreasing, excellent detergency can be achieved even at a low surfactant concentration in a washing liquid.

25 Claims, 3 Drawing Sheets

WASHING METHOD AND DETERGENT COMPOSITIONS

This application is a 371 of PCT/JP96/02485 filed Sep. 2, 1996.

TECHNICAL FIELD

The present invention relates to a washing method and a detergent composition. More specifically, the present invention relates to a washing method having excellent detergency even with a low surfactant concentration in the washing liquid by decreasing water hardness of the washing liquid before increasing pH of the washing liquid, and a detergent composition.

BACKGROUND ART

Generally, it is known that the addition of metal ion capturing agents, such as zeolites, to detergents reduces the effects of calcium ions and magnesium ions in tap water on surfactants, thereby removing dirt stains adhered to clothes, while the detergents inhibiting redeposition owing to freed dirt stains by making the washing liquid alkaline to increase dispersion of the dirt stains.

Therefore, in general, conventional detergent granules include alkalizing agents and metal ion capturing agents. The detergent granules are generally produced by the following method.

Specifically, a slurry comprising aqueous dispersion of surfactants, mainly comprising anionic surfactants and nonionic surfactant; alkalizing agents, such as sodium carbonate and sodium silicates; calcium ion capturing agents (metal ion capturing agents), such as zeolites and sodium tripolyphosphates; fillers, such as sodium sulfate; and other components (those which are stable against heat) is prepared. Thereafter, the resulting slurry is dried to be powdered. Subsequently, materials which are unstable against heat including perfumes, and in certain cases, bleaching agents and bleaching activators are post-blended, to give desired detergent granules.

Incidentally, phosphorus-based metal ion capturing agents typically exemplified by tripolyphosphates have been formulated in dry granules, the tripolyphosphates being generally employed as calcium ion capturing agents before the use of zeolites. This is due to the fact that the phosphorus-based metal ion capturing agents have a function of alkalizing agents besides the calcium ion capturing capacity and also have the most suitable properties for improvement in powder properties, such as flowability, of the dry granules.

In the detergent granules mentioned above, since the alkalizing agents, such as alkali metal carbonates and alkali metal silicates, also have the characteristics of improving flowability by mechanically strengthening the granules themselves, the alkalizing agents act to form into granules with surfactants having plasticity and zeolite fine particles, so that the alkalizing agents are generally included in the same granules as the surfactants and the zeolites.

As mentioned above, since the metal ion capturing agents and the alkalizing agents are formulated in the same granule in the conventional detergents, the dissolution of these components may simultaneously show alkalizing ability and metal ion capturing capacity in the washing liquid. In certain cases, the alkalizing ability is shown earlier than the metal ion capturing capacity because the rate of reaction of the metal ion capturing agents with calcium ions and magnesium ions in water is delayed more than the rate of reaction of an alkalizing agent and water. The same can be said for liquid detergents, and since the metal ion capturing agents and the alkalizing agents are mixed in the same liquid, the alkalizing ability and the metal ion capturing capacity may be simultaneously shown, or the alkalizing ability is shown earlier than the metal ion capturing capacity.

Aside from the above, most man-derived sebum dirt stains contain fatty acids. In the process of washing, calcium and magnesium together with fatty acids form a scum, thereby lowering solubility and inhibiting the dispersion of the dirt stains in water. In particular, the present inventors have found that the scum-formation rate becomes faster as the alkalization degree (pH) becomes higher, and that washing performance cannot be exhibited to its optimum in conventional washing methods.

On the other hand, besides ones mentioned above, several methods comprising dry-blending alkalizing agents as separate granules from detergent granules have been conventionally known.

For instance, (1) Japanese Examined Patent Publication No. 3-52798 discloses a method for producing detergent builders having a small bulk density comprising adding organic compounds, such as polyethylene glycols, to alkali metal carbonates and/or alkali metal sulfates; and granulating the resulting mixture. In this publication, however, the purpose is to improve the granular strength and the solubility, not to increase the detergency effects by making the dissolution of the alkalizing agents delayed more than that of the metal ion capturing agents. Therefore, the alkalizing agent particles shown in Examples contain a small amount of a binder, and the polyethylene glycol has a low molecular weight, never teaching a delayed exertion of the alkalizing ability.

(2) Japanese Patent Laid-Open No. 55-52396 discloses a method of dry-blending particular alkali metal silicate granules to detergent granules containing surfactants and chelating agents, such as zeolites. In this publication, however, the purpose is to prevent the formation of water-insoluble materials owing to mutual interactions between silicates and zeolites and to maintain anti-corrosive effects on the washing machines, but not to increase the detergency effects by making the dissolution of the alkalizing agents delay more than that of the chelating agents. Therefore, the silicate granules shown in Examples have a large particle size, but they are not intended to delay the alkalizing ability by changing the particle sizes.

(3) Japanese Patent Laid-Open No. 62-167399 discloses a method for producing detergent granules having a high bulk density by limiting the amount of water-soluble, crystalline inorganic salts in the detergent base materials and dry-blending alkalizing agents with detergent granules in order to prevent the decrease in solubility of the detergent granules by increasing bulk densities thereof. However, for the same reasons set forth in (2) above, this publication does not suggest the increase in the detergency effects by making the dissolution of the alkalizing agents delay more than that of the metal ion capturing agent.

(4) Japanese Patent Laid-Open No. 58-213099 discloses a method for producing clothes detergents comprising dry-blending sodium carbonate with spray-dried powdery detergent base materials, the sodium carbonate having a particular density, particle size, and particle size distribution. The purposes of this publication, however, are to improve caking resistance and to prevent classification of sodium carbonate, and not to increase the detergency effects by making the dissolution of the alkalizing agents delay more than that of the metal ion capturing agents. Therefore, even in Examples, sodium silicate is included in the detergent base materials in relatively large amounts, the sodium silicates being incorporated in the same granules as zeolites, which are metal ion capturing agents.

Accordingly, there are no prior art references having the purpose of exhibiting an alkalizing ability to be delayed more than that of the metal ion capturing capacity. In the methods of post-blending alkalizing agents as described above, the alkalizing agents are blended simply for the following purposes: Since the zeolites are water-insoluble, the alkalizing agents are added for preventing the zeolites to remain on fibers caused by the action of the silicates to suppress the dispersion of the zeolite in cases where the zeolites are blended with silicates in the form of fine particles. Also, the alkalizing agents are added to improve caking resistance and solubility of the detergents. Moreover, in the conventional detergents mentioned above, since the alkalizing agents directly contact the washing liquid, the initiation of the alkalizing effect is faster than the case where the metal ion capturing agent and the surfactants are formulated in the same granules.

DISCLOSURE OF THE INVENTION

An object of the present invention is to provide a washing method having excellent detergency even when the surfactant concentration is low by washing under the conditions that the increase in pH of the washing liquid occurs after the decrease in the water hardness of the washing liquid. Also, another object of the present invention is to provide a detergent composition which can be suitably used for the above washing method.

As a result of intensive research, the present inventors have found that the detergency is remarkably increased even when the surfactant concentration is low by washing under the conditions that the increase in the pH of the washing liquid occurs after the decrease in the water hardness of the washing liquid. The present invention has been completed based upon this finding.

Specifically, the present invention is concerned with the following:

(1) A washing method characterized in that washing is carried out under conditions that a pH of a washing liquid starts increasing after water hardness of the washing liquid starts decreasing;

(2) The washing method described in item (1) above, wherein an alkalizing agent is added after a metal ion capturing agent is started adding;

(3) The washing method described in item (1) or item (2) above, wherein the alkalizing agent is started dissolving or dispersing after the metal ion capturing agent is started dissolving or dispersing;

(4) The washing method described in any one of items (1) to (3) above, wherein the alkalizing agent is started dissolving or dispersing after a surfactant is started dissolving or dispersing;

(5) The washing method described in any one of items (1) to (4) above, wherein the maximum pH value of the washing liquid is equal to or greater than 10.6 at 25° C. under conditions that clothes are absent in the washing liquid;

(6) A detergent composition characterized by containing particles capable of delayed-exerting an alkalizing effect in a washing liquid (hereinafter simply referred to "alkali delayed-action particles"), wherein a pH of a washing liquid starts increasing after water hardness of the washing liquid starts decreasing;

(7) The detergent composition described in item (6) above, characterized in that the detergent composition comprises a metal ion capturing agent in a calculated amount sufficient to give water hardness of the washing liquid of 0.5° DH or less, and an alkalizing agent in an amount sufficient to give a pH of equal to or greater than 10.6 at 25° C. under conditions that clothes are absent in the washing liquid, wherein the alkalizing agent is started dissolving or dispersing after the metal ion capturing agent is started dissolving or dispersing;

(8) The detergent composition described in item (6) or item (7) above, wherein the alkali delayed-action particles are alkalizing agent particles coated with an organic material, or with organic and inorganic materials;

(9) The detergent composition described in any one of items (6) to (8) above, wherein the alkali delayed-action particles occupy an amount of 70% by weight or more of the entire alkalizing agents in the detergent composition;

(10) The detergent composition described in item (8) or item (9) above, wherein the content of a coating agent in the alkali delayed-action particles is from 10 to 80% by weight;

(11) The detergent composition described in any one of items (6) to (10) above, wherein the alkalizing agents in the alkali delayed-action particles are alkali metal carbonates and/or alkali metal silicates;

(12) The detergent composition described in item (11) above, wherein the alkali metal carbonate is sodium carbonate;

(13) The detergent composition described in item (11) above, wherein the alkali metal silicates are crystalline alkali metal silicates;

(14) The detergent composition described in item (13) above, wherein the alkali metal silicate is represented by the following formula (1):

$$xM_2O.ySiO_2.zMe_mO_n.wH_2O, \quad (1)$$

wherein M stands for an element in Group Ia of the Periodic Table; Me stands for one or more members selected from elements in Groups IIa, IIb, IIIa, IVa, and VIII of the Periodic Table; y/x is from 0.5 to 2.6; z/x is from 0.01 to 1.0; n/m is from 0.5 to 2.0; and w is from 0 to 20;

(15) The detergent composition described in item (13) above, wherein the alkali metal silicate is represented by the following formula (2):

$$M_2O.x'SiO_2.y'H_2O, \quad (2)$$

wherein M stands for an alkali metal; x' is from 1.5 to 2.6; and y' is from 0 to 20;

(16) The detergent composition described in any one of items (6) to (15) above, characterized in that in a case of a standard amount of dosage (0.40 to 1.00 g/L for a case where water hardness of the washing liquid used is from 2 to 6° DH; 0.5 to 0.67 g/L for a case where water hardness of the washing liquid used is from 6 to 10° DH; or 0.80 to 2.50 g/L for a case where water hardness of the washing liquid is from 10 to 20° DH), the surfactant is contained in an amount sufficient to give a surfactant concentration of 0.07 g/L or more in the washing liquid, and that the alkalizing agent is started dissolving or dispersing after the surfactant is started dissolving or dispersing;

(17) A detergent composition comprising an alkalizing agent coated with an organic material, or organic and inorganic materials, the alkalizing agent occupying an amount of 70% by weight or more of the entire alkalizing agents in the detergent composition;

(18) The detergent composition described in item (17) above, wherein the coated alkalizing agents are agglomerated alkali particles obtainable by granulation;

(19) The detergent composition described in item (18) above, wherein 70% by weight or more of a metal ion capturing agent other than the alkali metal silicates is present outside of the agglomerated alkali particles in the detergent composition;

(20) The detergent composition described in item (18) or item (19) above, wherein substantially no metal ion capturing agents other than the crystalline alkali metal silicates are contained inside the agglomerated alkali particles;

(21) The detergent composition described in any one of items (18) to (20) above, wherein surfaces of the agglomerated alkali particles are coated with the metal ion capturing agent;

(22) The detergent composition described in any one of items (17) to (21) above, wherein the alkalizing agents in the agglomerated alkali particles are alkali metal carbonates and/or alkali metal silicates;

(23) The detergent composition described in item (22) above, wherein the alkali metal carbonate is sodium carbonate;

(24) The detergent composition described in item (22) above, wherein the alkali metal silicates are crystalline alkali metal silicates;

(25) The detergent composition described in item (24) above, wherein the alkali metal silicate is represented by the following formula (1):

$$xM_2O.ySiO_2.zMe_mO_n.wH_2O, \quad (1)$$

wherein M stands for an element in Group Ia of the Periodic Table; Me stands for one or more members selected from elements in Groups IIa, IIb, IIIa, IVa, and VIII; y/x is from 0.5 to 2.6; z/x is from 0.01 to 1.0; n/m is from 0.5 to 2.0; and w is from 0 to 20; and

(26) The detergent composition described in item (24) above, wherein the alkali metal silicate is represented by the following formula (2):

$$M_2O.x'SiO_2.y'H_2O, \quad (2)$$

wherein M stands for an alkali metal; x' is from 1.5 to 2.6; and y' is from 0 to 20.

BEST MODE FOR CARRYING OUT THE INVENTION

Figure 1:
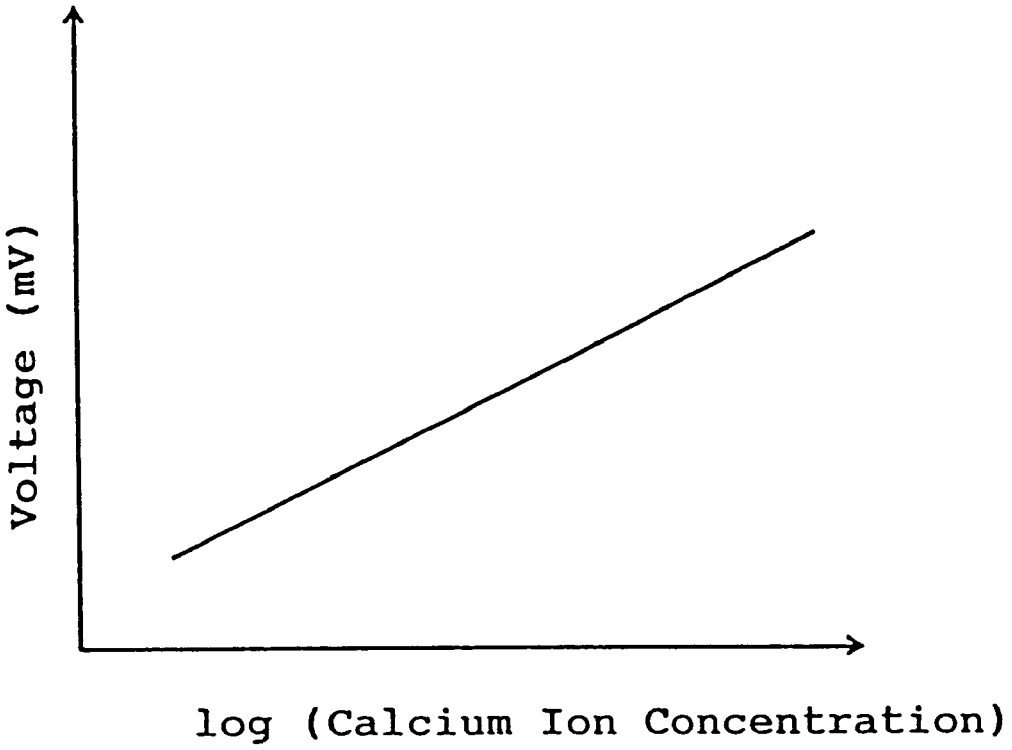
FIG. 1 is a graph of a calibration curve showing the relationship between the logarithm of the calcium ion concentration and the voltage.

The washing method of the present invention is characterized in that washing is carried out under conditions that a pH of a washing liquid starts increasing after water hardness of the washing liquid starts decreasing.

The method for washing under the above conditions may be either one of the following methods: For instance, an alkalizing agent is added after a metal ion capturing agent is started adding, or the alkalizing agent is started dissolving or dispersing after the metal ion capturing agent is started dissolving or dispersing. Alternatively, the alkalizing agent may be started adding after the water hardness of the washing liquid starts decreasing.

The above conditions may be such that when noting to the pH during the process of a gradual decrease in water hardness, in a case where water hardness being decreased of the washing liquid is 3.5° DH or more, preferably 1.5° DH or more, more preferably 0.8° DH or more, during wash, the pH values are preferably not exceeding 10.5, more preferably not exceeding 10.0. When the pH values exceeds the upper limit of the above range during the decreasing water hardness, the formation of soaps with fatty acids and the scum formation competitively take place, so that a sufficient detergency is not liable to be obtained. In other words, up to a point where the water hardness is sufficiently lowered, it is preferred that the increase of pH be delayed by the alkalizing agents. Therefore, it is preferred that when the water hardness be lowered to 3.5° DH or lower, preferably 1.5° DH or lower, more preferably 0.8° DH or lower, the pH preferably exceeds 10.0, more preferably exceeding 10.5, by the actions of the alkalizing agents, in order to obtain high detergency performance.

Further, the maximum pH value of the washing liquid during wash is preferably equal to or greater than 10.6 at 25° C. under measurement conditions that clothes are absent in the washing liquid, more preferably equal to or greater than 10.8. By having the maximum pH value of equal to or greater than 10.6, the detergency can be increased.

The standard amount of dosage of the detergents differs throughout the world. This is owing to the differences in the water hardness of tap water in each of the countries. For instance, while the tap water has water hardness of usually around 4° DH in Japan, the tap water has water hardness of not less than 6° DH in the U.S., and that exceeding 10° DH in European countries is used for the water for washing. Therefore, since the required absolute amount of the metal ion capturing agent varies, the standard amount of dosage would be adjusted accordingly. Although the amount of the metal ion capturing agent in the present invention varies depending upon the water hardness, the surfactant concentration in the washing liquid remains basically the same, and the standard amount of dosage becomes smaller than the conventional ones.

In the washing method of the present invention, in cases of standard amount of dosage of detergents (0.40 to 1.00 g/L for a case where the washing liquid used has water hardness of from 2 to 6° DH; 0.5 to 0.67 g/L for a case where the washing liquid used has water hardness of from 6 to 10° DH; or 0.80 to 2.50 g/L for a case where the washing liquid has water hardness of from 10 to 20° DH), the surfactant is contained in an amount sufficient to give a concentration of preferably 0.07 g/L or more in the washing liquid, more preferably 0.10 or more. When the concentration of the surfactant is less than 0.07 g/L, a sufficient detergency cannot be obtained even by the method of the present invention.

Incidentally, it is preferred that the dissolution or dispersion of the surfactant takes place before the dissolution or dispersion of the alkalizing agent, and it is preferred that the dissolution or dispersion of the surfactant takes place at a timing as close to the beginning of wash as possible.

The washing method of the present invention mentioned above may be carried out by suitably using the detergent compositions of the present invention detailed below, without intending to restrict the washing method of the present invention thereto.

The detergent composition of the present invention is characterized by containing the alkali delayed-action particles, wherein a pH of the washing liquid starts increasing after water hardness of the washing liquid starts decreasing.

In this case, specifically, in a standard amount of dosage of detergents (0.40 to 1.00 g/L for a case where the washing liquid used has water hardness of from 2 to 6° DH; 0.5 to 0.67 g/L for a case where the washing liquid used has water hardness of from 6 to 10° DH; or 0.80 to 2.50 g/L for a case where the washing liquid has water hardness from 10 to 20° DH), pH values of preferably not exceeding 10.5, more preferably not exceeding 10.0, are usable in a case where water hardness of the washing liquid of 3.5° DH or more, preferably 1.5° DH or more, more preferably 0.8° DH or more, during wash. When the pH values exceed the upper limit of the above range, the formation of soaps with fatty acids and the scum formation competitively take place, so that a sufficient detergency is not liable to be obtained.

The detergent composition of the present invention, for example, contains at least a surfactant, an alkalizing agent, and a metal ion capturing agent, wherein the metal ion capturing agent is contained in a calcULATED amount sufficient to give water hardness of the washing liquid of 0.5° DH or less in cases of standard amount of dosage of detergents (0.40 to 1.00 g/L for a case where the washing liquid used has water hardness of from 2 to 6° DH; 0.5 to 0.67 g/L for a case where the washing liquid used has water hardness of from 6 to 10° DH; or 0.80 to 2.50 g/L for a case where the washing liquid used has water hardness of from 10 to 20° DH), and wherein the alkalizing agent is contained in an amount sufficient to give a pH of equal to or greater than 10.6 at 25° C.

Here, the pH of the washing liquid is measured at 25° C. using such devices as a conventional glass electrode pH meter.

The amounts of the metal ion capturing agents to be present in the washing liquid (referring to amounts of the alkali metal silicates and the metal ion capturing agents other than alkali metal silicates), are calculated as follows.

The amount corresponding to ion capturing agents required to adjust the water hardness of the water for washing to 0.5° DH is calculated by calculating a concentration of Ca and Mg ions corresponding to the difference in water hardness from the water hardness of the water for washing used (the water hardness being different depending upon the countries; for instance, in Japan, the water hardness is about 4° DH), and then obtaining a total calcium ion capturing capacity corresponding to the calculated ion concentration in terms of concentration units. Here, the DH water hardness is measured by an ion coupling plasma method (ICP method).

Here, the methods for measuring the ion capturing capacity of the metal ion capturing materials vary depending upon whether the metal ion capturing materials are the ion exchange materials or the chelating agents. The measurement methods for each of the materials are given below.

Ion Exchange Materials

A 0.1 g sample is accurately weighed and added to 100 ml of a calcium chloride aqueous solution (500 ppm concentration, when calculated as $CaCO_3$), followed by stirring at 25° C. for 60 minutes, after which the mixture is filtered using a membrane filter (made of nitrocellulose; manufactured by Advantech) with 0.2 $\mu$m pore size. 10 ml of the filtrate is assayed for Ca content by an EDTA titration, and the calcium ion exchange capacity (cationic exchange capacity) of the sample is calculated from the titer.

Examples of those measured as the ion exchange materials in the present invention include inorganic substances, such as crystalline alkali metal silicates and aluminosilicates (zeolites, etc.).

Chelating Agents

The calcium ion capturing capacity is measured by the following method using a calcium ion electrode. Incidentally, the solution used herein is prepared with the following buffer solution:

Buffer solution: 0.1 M—$NH_4Cl$—$NH_4OH$ buffer (pH 10.0)

(1) Preparation of Calibration Curve

A standard calcium ion solution is prepared and used for obtaining a calibration curve showing the relationships between the logarithm of the calcium ion concentration and the voltage, as shown in FIG. 1.

(2) Measurement of Calcium Ion Capturing Capacity

Figure 2:
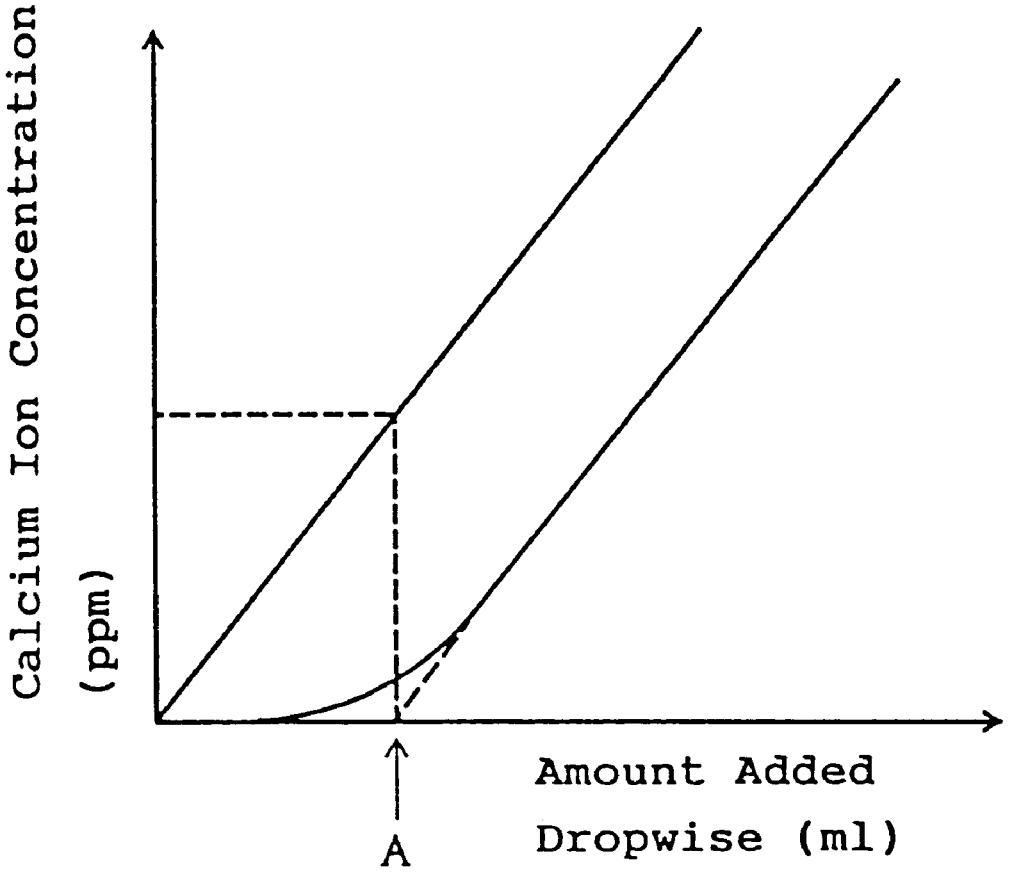
FIG. 2 is a graph showing the relationships between the amount of samples added dropwise and the calcium ion concentration.

About a 0.1 g sample is weighed into a 100 ml volumetric flask, and the volumetric flask is filled up to a volume of 100 ml with the above buffer solution. A $CaCl_2$ aqueous solution (pH 10.0) having a concentration of 20,000 ppm calculated as $CaCO_3$ is added dropwise from a burette in an amount of 0.1 to 0.2 ml to take each sample voltage reading (A blank sample solution is also measured). Thus, a calcium ion concentration is calculated from the calibration curve given in FIG. 1 by taking a sample voltage reading. The calcium ion concentration of the sample at an amount added dropwise A shown in FIG. 2 is referred to as calcium ion capturing capacity of the sample. Examples of those measured as the chelating agents in the present invention include polycarboxylates, such as citrates, and carboxylate polymers, such as acrylic acid-maleic acid copolymers. The metal ion capturing agent of the present invention refers to those having a calcium exchange capacity of 150 $CaCO_3$ mg/g or more, particularly 200 $CaCO_3$ mg/g or more. As for chelating agents, in the case where the values of $pK(Ca^{2+})$ (stability constant of a calcium ion chelate) are 3.2 or lower (as in the case of, for instance, citrates), since a sufficient decrease in water hardness cannot be desirably attained, the chelating agents should be contained in an amount of 15% by weight or less, preferably 10% by weight or less in the composition. In particular, the chelating agents are preferably contained in an amount of 30% by weight or less in the metal ion capturing agent. Here, $pK(Ca^{2+})$ is obtained in the manner described below.

Calculation of Stability Constant of Calcium Ion Chelate

The stability constant of calcium ion chelate ($pK(Ca^{2+})$) is obtained by using the results for the measurements of $Ca^{2+}$ ion capturing ability. It is calculated by assuming that 1:1 chelate is formed when equimolar calcium ions with the sample is added.

The stability constant of the chelate can be calculated according to the following equations:

$$M + L \leftrightharpoons ML$$

$$[M]_{TOTAL} = [ML] + [M]$$

$$[L]_{TOTAL} = [ML] + [L]$$

$$K_{ML} = \frac{[ML]}{[M]\ [L]}$$

Stability Constant of Chelate: $pK(M^{n+}) = \log K_{ML}$

Also, examples of the detergent compositions of the present invention include those wherein the dissolution or dispersion of alkalizing agents is started after the dissolution or dispersion of metal ion capturing agents; or those wherein the dissolution or dispersion of alkalizing agents is started after the dissolution or dispersion of surfactants is started.

Here, the term "alkali delayed-action particles" refers to particles capable of delayed-exerting an alkalizing effect in a washing liquid, wherein a pH of the washing liquid starts increasing after water hardness of the washing liquid starts decreasing. The alkali delayed-action particles include such particles as composite particles comprising alkalizing agents and an organic material or organic and inorganic materials coating on surfaces of the alkalizing agents.

The usable organic materials include nonionic surfactants, polyethylene glycols, and fatty acids, which are in a solid state at ambient temperature.

Examples of nonionic surfactants usable for coating the alkalizing agents include polyoxyethylene alkyl ethers, polyoxyethylene alkylphenyl ethers, polyoxyethylene sorbitan fatty acid esters, polyoxyethylene sorbitol fatty acid esters, polyethylene glycol fatty acid esters, alkyl polyoxyethylene glycol fatty acid esters, polyoxyethylene polyoxypropylene alkyl ethers, polyoxyethylene castor oils, and glycerol fatty acid esters.

Among them, a greater preference is given to polyoxyethylene alkyl ethers and/or polyoxyethylene alkylphenyl ethers from the viewpoint of detergency.

Examples of the polyethylene glycols include those having molecular weights of from 3,000 to 20,000. Examples of the fatty acids include saturated and/or unsaturated fatty acids having a carbon chain length of 12 to 20. Besides them, polyvinyl alcohols, hydroxypropyl methylcellulose, hydroxypropyl starches, and carboxymethyl cellulose having a low degree of polymerization are usable. Also, metal soaps having a high water-repellency, calcium carbonate, and silica powders may be also usable.

The content of the coating agents mentioned above in the alkali delayed-action particles is preferably from 10 to 80% by weight, more preferably from 30 to 70% by weight. When the content of the coating agent contained is less than the lower limit of the above range, sufficient alkali delay-action in the increase of pH is not liable to be achieved, and the content of the coating agent contained exceeds the upper limit of the above range, the dissolution to the washing liquid is drastically delayed, so that the washing time is limited and sufficient detergency cannot be obtained.

The alkali delayed-action particles (composite particles) may be produced by a method comprising the steps of using sufficient amounts of binders, such as a nonionic surfactant, a polyethylene glycol, and a fatty acid, and granulating the alkalizing agents. An alternative method comprises the step of coating an alkalizing agent with a coating agent in a fluidized bed, the coating agent comprising one or more members selected from polyvinyl alcohols, hydroxypropyl methylcellulose, hydroxypropyl starches, and carboxymethyl cellulose having a low degree of polymerization. In addition, while the granulation step or the coating step is carried out, metal soaps having a high water-repellency, slightly soluble calcium carbonate, and silica powders may be added.

The alkali delayed-action particles produced by the above methods may be used to give agglomerated alkali particles comprising agglomerates of the alkali delayed-action particles. Also, the outer surfaces of the above alkali delayed-action particles and the agglomerated alkali particles may be further coated with metal ion capturing agents.

The term "alkalizing agent" in the present invention refers to those which give a pH of 10 or higher in a solution being prepared by adding the alkalizing agent in an amount of 0.2 g in one liter of ion-exchanged water and stirred for three minutes to sufficiently dissolve or disperse in the solution. The alkaline solution also shows such an alkaline buffer ability such that when a 0.1 N hydrochloric acid solution is added to the above alkaline solution, the amount of the hydrochloric acid required is 3 ml or more to have the pH of the resulting solution reach a pH of 10. Therefore, in the present invention, zeolites, and sulfites, bicarbonates are not counted as the alkalizing agents of the present invention.

On the other hand, crystalline silicates disclosed in Japanese Patent Laid-Open Nos. 5-184946 and 60-74595 show metal ion capturing capacity at the same level as the zeolites, and since the crystalline silicates have high alkalizing ability, they are included in the alkalizing agents in the present invention.

Incidentally, the granulation of the above crystalline silicates together with binders containing a nonionic surfactant is disclosed in Japanese Patent Unexamined Publication No. 6-502445. The publication discloses granular products having excellent free-flowing properties. Moreover, in this method, the metal ion capturing agents are not limited to crystalline silicates alone but also include zeolite singly or zeolite in combination with the crystalline silicates. As far as can be seen from the examples of the publication, the purpose of the metal ion capturing agents is not intended to increase deterging effects by delaying the dissolution of the alkalizing agents more than that of the metal ion capturing agents. Accordingly, it does not suggest the technical idea of the present invention.

The usable alkalizing agents include alkali metal carbonates and alkali metal silicates, with a preference given to the alkali metal silicates. Among them, a preference is given to a case where the alkali metal carbonate is sodium carbonate and the crystalline silicates are alkali metal silicates.

The alkali metal silicates are not limited to the above, and they may include those of amorphous forms. However, a preference is given to crystalline forms which are capable of giving good ion exchange capacity as well as good alkalizing ability. By giving an ion exchange capacity to the alkalizing agents, a rapid lowering of the water hardness can be more easily achieved. However, since the exhibition of the alkalizing ability should be delayed, the ion exchange capacity of the alkalizing agents is auxiliary.

Among the crystalline alkali metal silicates usable in the present invention, a preference is given to those exemplified by having the following compositions (1) and (2) given below.

$$xM_2O.ySiO_2.zMe_mO_n.wH_2O, \quad (1)$$

wherein M stands for an element in Group Ia of the Periodic Table; Me stands for one or more members selected from elements in Groups IIa, IIb, IIIa, IVa, and VIII of the Periodic Table; y/x is from 0.5 to 2.6; z/x is from 0.01 to 1.0; n/m is from 0.5 to 2.0; and w is from 0 to 20.

$$M_2O.x'SiO_2.y'H_2O, \quad (2)$$

wherein M stands for an alkali metal; x' is from 1.5 to 2.6; and y' is from 0 to 20.

First, the crystalline alkali metal silicates having the composition (1) above will be detailed below.

In the general formula (1), M stands for an element selected from Group Ia of the Periodic Table, the Group Ia elements exemplified by Na, K, etc. The Group Ia elements may be used alone, or they may constitute an $M_2O$ component by blending such compounds as $Na_2O$ and $K_2O$.

Me stands for one or more members selected from elements in Groups IIa, IIb, IIIa, IVa, and VIII of the Periodic Table, and examples thereof include Mg, Ca, Zn, Y, Ti, Zr, and Fe. Although Me is not particularly limited to the above examples, a preference is given to Mg and Ca from the viewpoint of resource stock and safety. In addition, these elements may be used alone or they may constitute an $Me_mO_n$ component by blending such compounds as MgO and CaO.

In addition, the crystalline alkali metal silicates usable in the present invention may be in the form of hydrates, wherein the amount of hydration (w) is usually in the range of from 0 to 20.

With respect to the general formula, y/x is from 0.5 to 2.6, preferably from 1.5 to 2.2. When y/x is less than 0.5, the alkali metal silicate has insufficient anti-solubility in water, thereby providing drastically poor caking ability, solubility, and other powder properties of the detergent composition. When y/x exceeds 2.6, the alkali metal silicate has a low alkalizing ability, thereby making it insufficient to be used as an alkalizing agent, and it also has a low ion exchange capacity, thereby making it insufficient to be used as an ion exchange material. With respect to z/x, it is from 0.01 to 1.0, preferably from 0.02 to 0.9. When z/x is less than 0.01, the alkali metal silicate has insufficient anti-solubility in water, and when z/x exceeds 1.0, the alkali metal silicate has a low ion exchange capacity, making it insufficient to be used as an inorganic ion exchange material. With respect to x, y and z, there are no particular limitations, as long as y/x and z/x have the above relationships. When $xM_2O$,for example, is $x'Na_2O.x''K_2O$ as described above, x equals to x'+x". The same can be said for z when $zMe_mO_n$ comprises two or more components. Further, "n/m is from 0.5 to 2.0" indicates the number of oxygen ions coordinated to the above elements, which actually takes values selected from 0.5, 1.0, 1.5, and 2.0.

The crystalline alkali metal silicate in the present invention comprises three components, $M_2O$, $SiO_2$, and $Me_mO_n$, as indicated by the general formula above. Each of these components, therefore, is indispensable for starting materials for producing the crystalline alkali metal silicate in the present invention. In the present invention, known compounds can be suitably used for starting materials without particular limitations. Examples of the $M_2O$ component and the $Me_mO_n$ component include simple or complex oxides, hydroxides and salts of respective elements; and minerals containing respective elements. Specifically, examples of the starting materials for the $M_2O$ component include NaOH, KOH, $Na_2CO_3$, $K_2CO_3$, and $Na_2SO_4$. Examples of the starting materials for the $Me_mO_n$ component include $CaCO_3$, $MgCO_3$, $Ca(OH)_2$, $Mg(OH)_2$, MgO, $ZrO_2$, and dolomite. Examples of the starting materials for the $SiO_2$ component include silica sand, kaolin, talc, fused silica, and sodium silicates.

In the present invention, a method of preparing the crystalline alkali metal silicates may be exemplified by blending these starting material components in an amount ratio so as to provide the desired compositions in x, y, and z for the crystalline alkali metal silicates, and baking the resulting mixture at a temperature in the range of usually from 300 to 1500° C., preferably from 500 to 1000° C., more preferably from 600 to 900° C., to form crystals. In this case, when the heating temperature is less than 300° C., the crystallization is insufficient, thereby making the anti-solubility in water of the resulting crystalline alkali metal silicates poor, and when the heating temperature exceeds 1500° C., coarse grains are likely to be formed, thereby decreasing the ion exchange capacity of the resulting crystalline alkali metal silicates. The heating time is usually 0.1 to 24 hours. Such baking can usually be carried out in a heating furnace such as an electric furnace or a gas furnace.

The crystalline alkali metal silicates in the present invention thus obtained has a pH of equal to or higher than 10.6 in a 0.2% by weight dispersion solution, showing an excellent alkalizing ability. Also, the crystalline alkali metal silicates particularly excels in their alkaline buffering effects, having superior alkaline buffering effects when compared with those of sodium carbonate and potassium carbonate.

The crystalline alkali metal silicate in the present invention thus obtained has good ion exchange capacity as well as alkalizing ability, indicating an ion exchange capacity of equal to or higher than 100 mg $CaCO_3$/g, preferably from 200 to 600 mg $CaCO_3$/g.

Since the crystalline alkali metal silicate in the present invention has not only good alkalizing ability and alkali buffering effects but also good ion exchange capacity, the above-mentioned washing conditions are suitably adjusted by adding suitable amounts of the crystalline alkali metal silicates.

In the present invention, the crystalline alkali metal silicate usable in the present invention has an average particle size preferably of from 0.1 to 20 $\mu$m, more preferably from 1 to 30 $\mu$m, still more preferably from 1 to 10 $\mu$m. When the average particle size of the crystalline alkali metal silicate exceeds the upper limit of the above range, the ion exchange speed thereof is likely to be delayed, thereby resulting in lowering of the detergency. In addition, when the average particle is less than the lower limit of the above range, the specific surface area increases, thereby increasing the hygroscopic property and the $CO_2$ absorption property, which in turn makes it likely to cause marked deterioration of quality. Here, the average particle size referred herein is a median diameter obtained from a particle size distribution.

The crystalline alkali metal silicates having the average particle size and the particle size distribution mentioned above can be prepared by pulverizing the material using such pulverization devices as a vibrating mill, a hammer mill, a ball-mill, and a roller mill.

The content of the crystalline alkali metal silicates is preferably from 3 to 75% by weight in the entire composition, with a particular preference given to the following contents: In the case of using water for washing having water hardness of from 2 to 6° DH, the content is from 8 to 55% by weight of the crystalline alkali metal silicate being added to the entire detergent composition; in the case of using the water for washing having water hardness of 6 to 10° DH, the content is from 5 to 45% by weight of the crystalline alkali metal silicate being added to the entire detergent composition; and in the case of using the water for washing having water hardness of 10 to 20° DH, the content is from 3 to 30% by weight of the crystalline alkali metal silicate being added to the entire detergent composition.

Next, the crystalline alkali metal silicates having the composition (2) above are detailed below.

These crystalline alkali metal silicates are represented by the general formula (2):

$$M_2O.x'SiO_2.y'H_2O, \quad (2)$$

wherein M stands for an alkali metal; x' is from 1.5 to 2.6; and y' is from 0 to 20.

Among them, a preference is given to the crystalline alkali metal silicates having x' and y' in the general formula (2) such that each satisfies $1.7 \leqq x' \leqq 2.2$ and $y'=0$, and those having a cationic exchange capacity of from 100 to 400 $CaCO_3$ mg/g are usable.

Since the crystalline alkali metal silicates in the present invention have not only good alkalizing ability and alkaline buffering effects but also good ion exchange capacity, the above-mentioned washing conditions are suitably adjusted by adding suitable amounts of the crystalline alkali metal silicates.

The content of the crystalline alkali metal silicates is preferably 3 to 75% by weight in the entire composition, with a particular preference given to the following contents: In the case of using water for washing having water hardness of from 2 to 6° DH, the content is from 8 to 55% by weight of the crystalline alkali metal silicate being added to the entire detergent composition; in the case of using the water for washing having water hardness of 6 to 10° DH, the content is from 5 to 45% by weight of the crystalline alkali metal silicate being added to the entire detergent composition; and in the case of using the water for washing having water hardness of 10 to 20° DH, the content is from 3 to 30% by weight of the crystalline alkali metal silicate being added to the entire detergent composition.

A method for producing the above crystalline alkali metal silicates is disclosed in Japanese Patent Laid-Open No. 60-227895. However, the crystalline silicates can be generally produced by baking glassy amorphous sodium silicates at a temperature of from 200 to 1000° C. Details of the production method is disclosed in "Phys. Chem. Glasses, 7, pp.127–138 (1966), and Z. Kristallogr., 129, pp.396–404 (1969)." Also, the crystalline alkali metal silicates are commercially available in powdery or granular forms under a trade name "Na-SKS-6" ($\delta$-$Na_2Si_2O_5$) (manufactured by Hoechst).

In the present invention, as in the case of the crystalline alkali metal silicates having the composition (1), the crystalline alkali metal silicates having the composition (2) have an average particle size of preferably from 0.1 to 50 $\mu$m, more preferably from 1 to 30 $\mu$m, still more preferably from 1 to 10 $\mu$m.

In the present invention, the crystalline alkali metal silicates having the compositions (1) and (2) may be used alone or in combination. It is preferred that the crystalline alkali metal silicates occupy 50 to 100% by weight of the total alkalizing agent contents, more preferably 70 to 100% by weight.

In the present invention, the alkalizing agents are contained in an amount of usually from 10 to 75% by weight in the detergent composition, wherein 70% by weight or more, more preferably 80% by weight, most preferably 90% by weight or more, of the alkalizing agents are preferably contained in the above composite particles. By containing the alkalizing agents in an amount of 70% by weight or more, the effects of the present invention can be suitably obtained by the delaying of the exhibition of the alkalizing ability.

In the detergent composition of the present invention, the coated alkalizing agents may be granulated (or agglomerated) to form relatively large particles as mentioned above. In this case, the metal ion capturing agents other than the alkali metal silicates are preferably not incorporated inside the agglomerated particles, i.e. agglomerated alkali particles. Specifically, 70% by weight or more, preferably 80% by weight or more, most preferably 90% by weight or more, of the metal ion capturing agents are excluded from the inside of the agglomerated particles. Still more preferably, no metal ion capturing agents other than the alkali metal silicates are substantially included in the agglomerated particles.

As described above, in the present invention, the metal ion capturing agents other than the alkali metal silicates are preferably present outside of the agglomerated alkali particles, with a preference given to a case where outer surfaces of the agglomerated alkali particles are coated by the metal ion capturing agents from the viewpoint of making the capturing of metal ions faster than the exhibition of the alkalizing ability. Incidentally, the metal ion capturing agents used in this case is preferably an aluminosilicate which also has a function of improving powder properties of the granular compositions. The metal ion capturing agents coating the outer surfaces of the agglomerated alkali particles are preferably contained in an amount of from 2 to 20% by weight of the coated particles.

The surfactants usable in the present invention are not particularly limited, and any ones generally used for detergents may be used. Specifically, they may be one or more surfactants selected from the group consisting of nonionic surfactants, anionic surfactants, cationic surfactants, and amphoteric surfactants, each being exemplified below. For instance, the surfactants may be chosen such that the surfactants of the same kind are chosen, as in the case where a plurality of the nonionic surfactants may be chosen. Alternatively, the surfactants of the different kinds are chosen, as in the case where the anionic surfactant and the nonionic surfactant are respectively chosen.

Examples of the nonionic surfactants, including those listed above, are as follows:

Polyoxyethylene alkyl ethers, polyoxyethylene alkylphenyl ethers, polyoxyethylene sorbitan fatty acid esters, polyoxyethylene sorbitol fatty acid esters, polyethylene glycol fatty acid esters, polyethylene glycol fatty acid alkyl esters, polyoxyethylene polyoxypropylene alkyl ethers, polyoxyethylene castor oils, polyoxyethylene alkylamines, glycerol fatty acid esters, higher fatty acid alkanolamides, alkylglucosides, alkylglucosamides, and alkylamine oxides.

Among the nonionic surfactants, a particular preference is given to polyoxyethylene alkyl ethers which are ethylene oxide adducts of linear or branched, primary or secondary alcohols, each having 10 to 18 carbon atoms, with an average adduct molar number of 5 to 15, and more preferably polyoxyethylene alkyl ethers which are ethylene oxide adducts of linear or branched, primary or secondary alcohols, each having 12 to 14 carbon atoms, with an average adduct molar number of 6 to 10.

Examples of the anionic surfactants include alkylbenzenesulfonates, alkyl or alkenyl ether sulfates, alkyl or alkenyl sulfates, $\alpha$-olefinsulfonates, $\alpha$-sulfofatty acid salts, $\alpha$-sulfofatty acid ester salts, alkyl or alkenyl ether carboxylates, amino acid-type surfactants, and N-acyl amino acid-type surfactants, with a preference given to alkylbenzenesulfonates, alkyl or alkenyl ether sulfates, and alkyl or alkenyl sulfates.

Examples of the cationic surfactants include quaternary ammonium salts, such as alkyl trimethylamine salts. Examples of the amphoteric surfactants include carboxy-type and sulfobetaine-type amphoteric surfactants.

The content of the surfactants is preferably from 5 to 70% by weight. Particularly, the content of the surfactants are in the following ranges: In the case where the water for washing having water hardness of 2 to 6° DH, the content is from 10 to 50% by weight; in the case of using the water for washing having water hardness of 6 to 10° DH, the content is from 5 to 40% by weight; and in the case of using the water for washing having water hardness of 10 to 20° DH, the content is from 3 to 30% by weight.

The content of the surfactant mentioned above is an amount sufficient to give a surfactant concentration of equal to or higher than 0.07 g/L in the washing liquid in cases of standard amount of dosage of detergents (0.40 to 1.00 g/L for a case where the water for washing used is from 2 to 6° DH; 0.5 to 0.67 g/L for a case where the water for washing used is from 6 to 10° DH; or 0.80 to 2.50 g/L for a case where the water for washing is from 10 to 20° DH).

As for the metal ion capturing agents, a carboxylate polymer having a calcium ion capturing capacity of 200 $CaCO_3$ mg/g or more is preferably contained in an amount of 10% by weight or more in the entire amount of the metal ion capturing agent.

Examples of the above carboxylate polymer include polymers or copolymers, each having repeating units represented by the general formula (3):

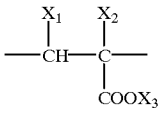

(3)

wherein $X_1$ stands for methyl, a hydrogen atom, or $COOX_3$; $X_2$ stands for methyl, a hydrogen atom, or hydroxyl; $X_3$ stands for a hydrogen atom, an alkali metal, an alkaline earth metal, an ammonium, or ethanolamine.

In the general formula (3), examples of the alkali metals include Na, K, and Li, and examples of the alkaline earth metals include Ca and Mg.

Examples of the polymers or copolymers usable in the present invention include those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other polymerizable monomers. Here, examples of the copolymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic ester, without particularly being limited thereto. Incidentally, the polymerization reactions are not particularly limited, and any of the conventionally known methods may be employed.

Also, polyacetal carboxylic acid polymers such as polyglyoxylic acids disclosed in Japanese Patent Laid-Open No. 54-52196 are also usable for the polymers in the present invention.

In the present invention, the above polymers and copolymers usually having a weight-average molecular weight of from 800 to 1,000,000, preferably from 5,000 to 200,000, may be used. When the weight-average molecular weight of the polymers and copolymers is less than 800, the effects of the present invention intrinsic to the properties owned by the polymers cannot be obtained, and when the weight-average molecular weight exceeds 1,000,000, redeposition takes place owing to the influence of the polymers, thereby inhibiting achievement of a good washing performance.

Also, in the case of copolymers, although the copolymerization ratio between the repeating units of the general formula (3) and other copolymerizable monomers is not particularly limited, a preference is given to a copolymerization ratio of the repeating units of general formula (3)/other copolymerizable monomer=1/100 to 90/10.

In addition, as the metal ion capturing agents, the detergents may contain an aluminosilicate having an ion exchange capacity of 200 $CaCO_3$ mg/g or more and having the following formula (4):

$$x''(M_2O).Al_2O_3.y''(SiO_2).w''(H_2O), \quad (4)$$

wherein M stands for an alkali metal, such as sodium or potassium; x", y", and w" each stands for a molar number of each component; and generally, x" is from 0.7 to 1.5; y" is from 0.8 to 6; and w" is an arbitrary constant.

The aluminosilicates mentioned above may be crystalline or amorphous, and among the crystalline aluminosilicates, a particular preference is given to those having the following general formula:

$$Na_2O.Al_2O_3.ySiO_2.wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 μm, which are typically exemplified by A-type zeolite, X-type zeolite, and P-type zeolite, are suitably used. The zeolites may be used in the forms of powder, a zeolite slurry, or dried particles comprising zeolite agglomerates obtained by drying the slurry. The zeolites of the above forms may also be used in combination.

The above crystalline aluminosilicates are obtainable by conventional methods. For instance, methods disclosed in Japanese Patent Laid-Open Nos. 50-12381 and 51-12805 may be employed.

On the other hand, the amorphous aluminosilicates represented by the same general formula as the above crystalline aluminosilicate are also obtainable by conventional methods. For instance, the amorphous aluminosilicates are prepared by adding an aqueous solution of a low-alkali alkali metal aluminate having a molar ratio of $M_2O$ to $Al_2O_3$ (M standing for an alkali metal) of $M_2O/Al_2O_3$=1.0 to 2.0 and a molar ratio of $H_2O$ to $M_2O$ of $H_2O/M_2O$=6.0 to 500 to an aqueous solution of an alkali metal silicate having a molar ratio of $SiO_2$ to $M_2O$ of $SiO_2/M_2O$=1.0 to 4.0 and a molar ratio of $H_2O$ to $M_2O$ of $H_2O/M_2O$=12 to 200 under vigorous stirring at usually 15 to 60° C., preferably 30 to 50° C.

The intended product can be advantageously obtained by heat-treating a white slurry of precipitates thus formed at usually 70 to 100° C., preferably 90 to 100° C., for usually not less than 10 minutes and not more than 10 hours, preferably not more than 5 hours, followed by filtration, washing and drying. Incidentally, the aqueous solution of an alkali metal silicate may be added to the aqueous solution of a low-alkali alkali metal aluminate.

In the present invention, the content of the metal ion capturing agent in the entire composition is 10 to 90% by weight. Particularly, the above polymer or copolymer is contained in an amount of from 2 to 50% by weight, preferably from 5 to 30% by weight in the entire composition. When the amount of the polymer or copolymer is less than 2% by weight, the effects of the present invention cannot be obtained, and when the amount exceeds 50% by weight, a further addition of the polymer or copolymer to the composition shows no additional effects, and merely increases the costs thereof.

In the detergent composition of the present invention, examples of the metal ion capturing agents, other than those listed above, include detergent builders, such as aminotri (methylenephosphonic acid), 1-hydroxyethylidene-1,1-diphosphonic acid, ethylenediaminetetra (methylenephosphonic acid), diethylenetriaminepenta (methylenephosphonic acid), and salts thereof; salts of phosphonocarboxylic acids, such as salts of 2-phosphonobutane-1,2-dicarboxylic acid; amino acid salts, such as aspartates and glutamates; aminopolyacetates, such as nitrilotriacetates and ethylenediaminetetraacetates; and chelating agents, color-fading preventives, and anti-redeposition agents generally used for detergent compositions, including non-dissociating polymers, such as polyethylene glycols, polyvinyl alcohols, and polyvinyl pyrrolidones; builders, including organic acid salts, such as diglycolates and hydroxycarboxylates; and carboxymethyl cellulose.

Besides the above, the following ingredients may be also contained in the detergent composition of the present invention. Specifically, the detergent composition of the present invention may contain one or more ingredients selected from enzymes, such as proteases, lipases, cellulases, and amylases; caking preventives, such as lower alkylbenzenesulfonates whose alkyl moieties have about 1 to 4 carbon atoms, sulfosuccinates, talc, and calcium silicates; antioxidants, such as tert-butylhydroxytoluene, and distyrenated cresol; bleaching agents, such as sodium percarbonate; bleaching activators, such as tetraacetylethylenediamine; fluorescent dyes; blueing agents; and perfume, without being particularly limited thereto, to give compositions suitable for their purposes.

In the detergent compositions of the present invention, it is essential to include the alkali delayed-action particles and the metal ion capturing agents outside the alkali delayed-action particles. Besides the method of coating the alkali delayed-action particles with the metal ion capturing agent, the desired detergent granules may be obtained by dry-blending the alkali delayed-action particles with the metal ion capturing agent granules as separate granules. In this case, 80% by weight or more, more preferably 90% by weight or more, of the alkalizing agents in the entire detergent composition is preferably present in the alkali delayed-action particles. However, a small amount of alkalizing agents may be blended as separate granules other than the alkali delayed-action particles as backbone agents for retaining the mechanical strength of the particles. Although the detergent granules blended as separate granules are not particularly limited, they may be such that the amount of the alkalizing agents blended can be lowered compared with the conventional detergent granules. The detergent compositions of the present invention containing each of the components described above may be produced by any of the conventionally known methods without particular limitation. Examples of the methods for producing high-density detergents include the methods disclosed in Japanese Patent Laid-Open Nos. 61-69897, 61-69899, 61-69900, and 5-209200.

The present invention will be explained hereinbelow by means of the following working examples and comparative examples, but the present invention is by no means limited to these working examples.

The pH of the washing liquid was measured by adding a detergent composition to the water for washing and then measuring a pH at 25° C. with a glass electrode pH meter (manufactured by HORIBA Ltd.). Here, the value indicated which was the pH of the washing liquid was referred to that sufficiently stabilized value.

EXAMPLE 1 AND COMPARATIVE EXAMPLE 1

The metal ion capturing agent, the alkalizing agent, and the surfactant used, and their used amounts are as follows:

Metal Ion Capturing Agent

Zeolite 4A-Type (average particle size: 3 $\mu$m; Ca ion exchange capacity: 230 $CaCO_3$ mg/g; water content: 22%; manufactured by Tosoh Corporation); used amount=0.333 g/L (calculated water hardness being 4.29° DH).

Alkalizing Agent

Sodium metasilicate (andydrous product; manufactured by Nippon Kagaku Kogyo Kabushiki Kaisha); used amount=0.167 g/L.

Surfactant

Polyoxyethylene alkyl ether $nC_{12}$ POE=8 (manufactured by Kao Corporation); used amount=0.180 g/L.

Figure 3:
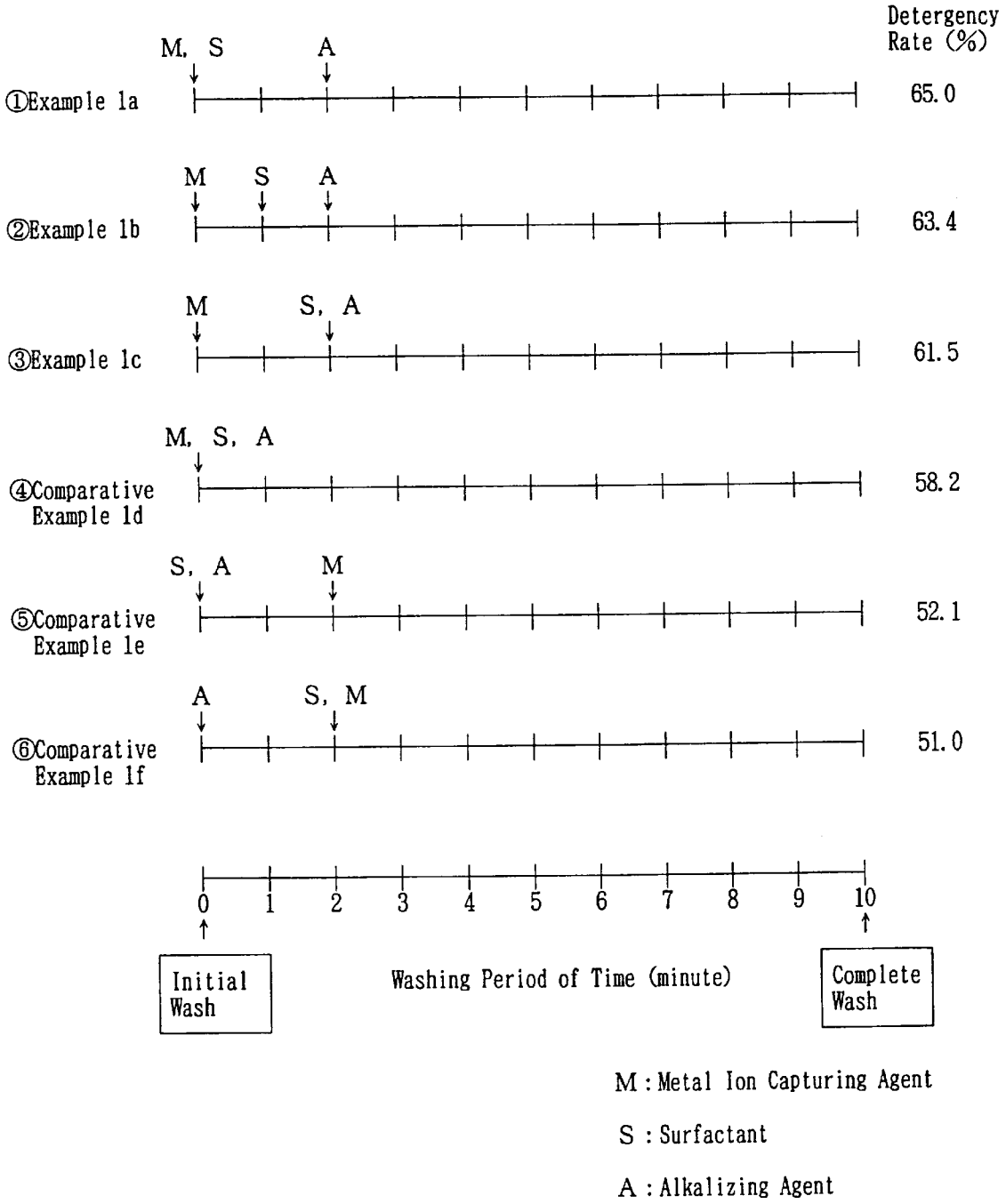
FIG. 3 is a time table showing timing for adding metal ion capturing agents, alkalizing agents, and surfactants in Example 1 and Comparative Example 1, together with detergency rate.

Washing of an artificially stained cloth in 4° DH water (Ca hard water) was carried out by using Turgotometer at a rotational speed of 100 rpm, at a temperature of 20° C. for a washing period of time of 10 minutes, in which each of the components were added according to a time table shown in FIG. 3.

Here, zeolite and sodium metasilicate powders were accurately weighed and then added directly to the Turgometer container (1000 ml capacity). Also, as for the polyoxyethylene alkyl ether, it was added by the method comprising the step of adding 5 ml of a 3.6% by weight aqueous solution of the polyoxyethylene alkyl ether to 995 ml of a washing liquid containing no polyoxyethylene alkyl ethers.

The detergency rate obtained after washing is shown in FIG. 3.

As a result, it was found that the detergency rates for Examples 1a to 1c of the present invention were high, where the alkalizing agent was added after the metal ion capturing agent has been added. However, in the case of Comparative Example 1d where the alkalizing agent and the metal ion capturing agent was simultaneously added or in cases of Comparative Examples 1e and 1*f* where the alkalizing agent was added before addition of the metal ion capturing agent, the detergency rates were notably lower than those of Examples.

Here, the above detergency rate was calculated by the following method using the artificially stained cloth prepared below.

Preparation of Artificially Stained Cloth

An artificial staining liquid having the following compositions was adhered to prepare an artificially stained cloth. Artificial staining liquid was printed on a cloth by an engravure staining machine equipped with an engravure roll coater disclosed in Japanese Patent Laid-Open No. 7-270395. The process for adhering the artificial staining liquid to a cloth to prepare an artificially stained cloth was carried out under the conditions of a cell capacity of a gravure roll of 58 $cm^3/cm^2$, a coating speed of 1.0 m/min, a drying temperature of 100° C., and a drying time of one minute. Here, a cloth (#2003 calico, manufactured by Senshokushizai Kabushikikaisha Tanigashira Shoten) was used.

Composition of Artificial Staining Liquid

| | |
|---|---|
| Lauric acid | 0.44% by weight |
| Myristic acid | 3.09% by weight |
| Pentadecanoic acid | 2.31% by weight |
| Palmitic acid | 6.18% by weight |
| Heptadecanoic acid | 0.44% by weight |
| Stearic acid | 1.57% by weight |
| Oleic acid | 7.75% by weight |
| Triolein | 13.06% by weight |
| n-Hexadecyl palmitate | 2.18% by weight |
| Squalene | 6.53% by weight |
| Egg white lecithin crystalline liquid | 1.94% by weight |
| Kanuma sekigyoku soil | 8.11% by weight |
| Carbon black | 0.01% by weight |
| Tap water | Balance |

Calculation of Detergency Rate

Reflectivities of the original cloth and those of the stained cloth before and after washing were measured at 550 mμm by means of an automatic recording calorimeter (manufactured by Shimadzu Corporation), and the detergency rate D (%) was calculated by the following equation.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

EXAMPLE 2 AND COMPARATIVE EXAMPLE 2

13.0% by weight of an acrylic acid-maleic acid copolymer (average molecular weight: 70,000; "SOKALAN CP5" manufactured by BASF Aktiengesellschaft), 74.0% by weight of zeolite (4A-type, average particle size: 2 μm), and 13.0% by weight of sodium sulfate were added together to form into slurry containing 50% solid components. The resulting slurry was spray-dried using a countercurrent-type spray dryer, to give particles with a water content of 5% of the dead weight. A high-speed mixer was charged with the amount 9.68 kg of the resulting particles, and 4.8 kg of amorphous aluminosilicate, and 8.0 kg of zeolite were added thereto. While the ingredients were agitated at room temperature, 7.2 kg of a polyoxyethylene alkyl ether ($nC_{12}$ POE=8) heated to 70° C. was gradually added dropwise thereto, to give Granulated Coated Product A (average particle size: 400 μm).

Also, separately, a high-speed mixer was charged with 24.0 kg of the following crystalline alkali metal silicate. While the ingredients were agitated at room temperature, 7.2 kg of a polyethylene glycol (average molecular weight: 6000) heated to 70° C. was gradually added dropwise thereto, to give Granulated Product B (average particle size: 400 μm), wherein the crystalline alkali metal silicate was coated with the polyethylene glycol.

Crystalline Alkali Metal Silicate:

$$x'Na_2O.x''K_2O.ySiO_2.z'CaO.z''MgO,$$

wherein x"/x'=0.03, y/(x'+x")=1.8, (z'+z")/(x'+x")=0.02, z"/z'=0.01, where the calcium ion exchange capacity (CEC) was 305 $CaCO_3$ mg/g.

Further, a high-speed mixer was charged with 7.26 kg of the spray-dried particles, 3.6 kg of the following amorphous aluminosilicate, 6.0 kg of zeolite, and 6.0 kg of the crystalline alkali metal silicate. While the ingredients were agitated at room temperature, a liquid mixture comprising 5.4 kg of the above polyoxyethylene alkyl ether and 1.8 kg of the polyethylene glycol heated at 70° C. was gradually added dropwise thereto, to give Granulated Product C (average particle size: 400 μm), wherein all the components were uniformly blended.

Amorphous Aluminosilicate:

$$Na_2O.Al_2O_3.3.1\ SiO_2.13\ H_2O$$

wherein CEC: 185 $CaCo_3$ mg/g, and oil-absorbing capacity: 285 ml/100 g.

Using 0.618 g of Granulated Product A and 0.217 g of Granulated Product B obtained above, washing was carried out in the same manner as in Example 1 while adding both Granulated Products A and B at the beginning of wash (the maximum pH value being 10.93). In addition, using 0.835 g of Granulated Product C, washing was carried out in the same manner as in Example 1 (maximum pH value being 10.91). The detergency rates were evaluated in the same manner as in Example 1. As a result, the detergency rate of Granulated Products A+B was 67.2%, and the detergency rate of Granulated Product C was 60.5%, thereby showing a higher detergency rate for Granulated Products A+B than that for Granulated Product C. Here, the composition of 0.62 g of Granulated Product A and 0.22 g of Granulated Product B is identical to that of 0.84 g of Granulated Product C.

EXAMPLE 3 AND COMPARATIVE EXAMPLE 3

6.3% by weight of sodium polyacrylate (average molecular weight: 10,000; degree of neutralization: 100%), 4.2% by weight of sodium citrate, 20.8% by weight of zeolite (4A-type, average particle size: 2 μm), 37.5% by weight of LAS-Na (sodium linear alkylbenzensulfonate, the number of carbon atoms of the alkyl moiety being 12), 10.4% by weight of AS-Na (sodium alkylsulfate, the number of carbon atoms of the alkyl moiety being 12) and 20.8% by weight of sodium sulfate were added together to form into slurry containing 50% solid components. The resulting slurry was spray-dried using a countercurrent-type spray dryer, to give particles with a water content of 5% of the dead weight. A high-speed mixer was charged with 25.27 kg of the resulting particles, and 8.5 kg of zeolite was added thereto, to give Granulated Product D (average particle size: 400 μm).

Also, separately, a high-speed mixer was charged with 28.0 kg of soda ash (anhydrous sodium carbonate). While the ingredients were agitated at room temperature, 5.0 kg of palmitic acid heated to 70° C. was gradually added dropwise thereto, to give Granulated Product E (average particle size: 400 μm).

Further, a high-speed mixer was charged with 15.16 kg of the spray-dried particles prepared above, 5.1 kg of zeolite, and 8.4 kg of the soda ash (anhydrous sodium carbonate). While the ingredients were agitated at room temperature, 1.5 kg of palmitic acid heated at 70° C. was gradually added dropwise thereto, to give Granulated Product F (average particle size: 400 μm) where all the components were uniformly blended.

Using 0.562 g of Granulated Product D and 0.275 g of Granulated Product E obtained above, washing was carried out in the same manner as in Example 1 while adding both Granulated Products D and E at the beginning of wash (the maximum pH value being 10.82). In addition, using 0.837 g of Granulated Product F, washing was carried out in the same manner as in Example 1 (maximum pH value being 10.80). The detergency rates were evaluated in the same manner as in Example 1. As a result, the detergency rate for Granulated Products D+E was 64.8%, and the detergency rate for Granulated Product F was 59.1%, thereby showing a higher detergency rate for Granulated Products D+E than that for Granulated Product F. Incidentally, the composition of 0.562 g of Granulated Product D and 0.275 g of Granulated Product E is identical to that of 0.837 g of Granulated Product F.

In addition, instead of using Granulated Product F, the soda ash was added as a slurry component with the weight ratio as above, to prepare spray-dried particles. A high-speed mixer was charged with the particles and zeolite, while the ingredients were agitated at room temperature, palmitic acid heated to 70° C. was gradually added dropwise thereto, to give Granulated Product G (average particle size: 400 $\mu$m), wherein all the components were uniformly blended.

Using 0.837 g of Granulated Product G, the washing was carried out in the same manner as above. As a result, the detergency rate was found to be 58.8%, so that the detergency rate for Granulated Products D+E were notably higher than that of Granulated Product G.

INDUSTRIAL APPLICABILITY

In the washing method and the detergent composition of the present invention, since washing is carried out under conditions that a pH of a washing liquid starts increasing after water hardness of the washing liquid starts decreasing, excellent detergency can be achieved even at a low surfactant concentration.

We claim:

1. A washing method for clothes comprising adding an alkalizing agent and a metal ion capturing agent to washing liquid and washing clothes under the conditions such that the pH of the washing liquid starts increasing after the water hardness of the washing liquid starts decreasing wherein the pH value of the washing liquid is increased to 10.6 or greater at 25° C. as measured when clothes are not present in the washing liquid.

2. The washing method of claim 1, wherein an alkalizing agent is added to said washing liquid after a metal ion capturing agent is added to said washing liquid.

3. The washing method of claim 1, wherein the metal ion capturing agent begins to dissolve or disperse in the washing liquid before the alkalizing agent begins to dissolve or disperse in the washing liquid.

4. The washing method of claim 1, wherein said method further comprises adding a surfactant to said washing liquid, and said surfactant begins to dissolve or disperse in said washing liquid before said alkalizing agent begins to dissolve or disperse in said washing liquid.

5. A detergent composition comprising particles capable of exerting a delayed alkalizing effect in washing liquid, and capable of increasing the pH of the washing liquid after the water hardness of the washing liquid starts decreasing, wherein the detergent provides a pH value to the washing liquid of 10.6 or greater at 25° C. as measured when clothes are not present in the washing liquid.

6. The detergent composition of claim 5, wherein said particles comprise (1) a metal ion capturing agent in an amount sufficient to provide a water hardness of the washing liquid of 0.5° DH or less; and (2) an alkalizing agent in an amount sufficient to provide a pH of the washing liquid of 10.6 or greater at 25° C. as measured when clothes are not present in the washing liquid; wherein the alkalizing agent dissolves or disperses in the washing liquid after the metal ion capturing agent begins dissolving or dispersing in the washing liquid.

7. The detergent composition of claim 5 or 6, wherein the particles capable of exerting a delayed alkalizing effect are particles comprising an alkalizing agent coated with an organic material, or a combination of organic and inorganic material.

8. The detergent composition of claim 6 wherein the alkalizing agent in said particles is present in an amount of 70% by weight of the total alkalizing agents in the detergent composition.

9. The detergent composition of claim 7, wherein the amount of a coating agent in the particles is from 10 to 80% by weight.

10. The detergent composition of claim 6, wherein the particles comprise at least one of an alkali metal carbonate and an alkali metal silicate.

11. The detergent composition of claim 10, wherein the alkali metal carbonate is sodium carbonate.

12. The detergent composition of claim 10, wherein the alkali metal silicate is a crystalline alkali metal silicate.

13. The detergent composition of claim 12, wherein the crystalline alkali metal silicate is represented by the following formula (1):

$$xM_2O\text{-}ySiO_2\text{-}zMe_mO_nwH_2O \quad (1)$$

wherein M is an element in Group Ia of the Periodic Table; Me is one or more members selected from elements in Groups IIa, IIb, IIIa, IVa, and VIII of the Periodic Table; y/x is 0.5 to 2.6; z/x is 0.01 to 1.0; n/m is 0.5 to 2.0; and w is 0 to 20.

14. The detergent composition of claim 12, wherein the crystalline alkali metal silicate is represented by the following formula (2):

$$M_2O\text{-}x'SiO_2\text{-}y'H_2O \quad (2)$$

wherein M is an alkali metal; x' is 1.5 to 2.6; and y' is 0 to 20.

15. The detergent composition of claim 5, which further comprises a surfactant present in an amount such that the detergent composition provides a concentration of at least 0.07 g/l of the surfactant in the washing liquid, and said surfactant dissolves or disperses in the washing liquid before the alkalizing agent dissolves or disperses in the washing liquid.

16. A detergent composition comprising coated and non-coated alkalizing agents and a metal ion capturing agent, wherein said coated alkalizing agents are coated with an organic material or an organic and inorganic material mixture and occupy an amount of at least 70% weight of the alkalizing agents present in said composition, and wherein the composition provides a pH of 10.6 or greater at 25° C. in a washing liquid as measured when clothes are not present in the washing liquid.

17. The detergent composition of claim 16, wherein the coated alkalizing agent is agglomerated alkali particles obtainable by granulation.

18. The detergent composition of claim 17, wherein at least 70% by weight of the metal ion capturing agents other than alkali metal silicates are present outside the agglomerated alkali particles.

19. The detergent composition of claim 17 or 18, wherein substantially no metal ion capturing agents other than crystalline alkali metal silicates are contained inside the agglomerated alkali particles.

20. The detergent composition of claim 17, wherein surfaces of the agglomerated alkali particles are coated with the metal ion capturing agent.

21. The detergent composition of claim 17, wherein the alkalizing agent in the agglomerated alkali particles is at least one of alkali metal carbonates and alkali metal silicates.

22. The detergent composition of claim 21, wherein the alkali metal carbonate is sodium carbonate.

23. The detergent composition according to claim 21, wherein the alkali metal silicate is a crystalline alkali metal silicate.

24. The detergent composition of claim 23, wherein the crystalline alkali metal silicate is represented by the following formula (1):

$$xM_2O\text{-}ySiO_2\text{-}zMe_mO_nwH_2O \quad (1)$$

wherein M is an element in Group Ia of the Periodic Table; Me is one or more members selected from elements in Groups IIa, IIb, IIIa, IVa, and VIII of the Periodic Table; y/x is 0.5 to 2.6; z/x is 0.01 to 1.0; n/m is 0.5 to 2.0; and w is 0 to 20.

25. The detergent composition of claim 23, wherein the crystalline alkali metal silicate is represented by the following formula (2):

$$M_2O\text{-}x'SiO_2\text{-}y'H_2O \quad (2)$$

wherein M is an alkali metal; x' is 1.5 to 2.6; and y' is 0 to 20.

* * * * *